US006068008A

United States Patent [19]

Caldwell

[11] Patent Number: 6,068,008

[45] **Date of Patent: *May 30, 2000**

[54] SELF-STANDING SHELTER WITH REEL-MOUNTED DEPLOYABLE AND RETRACTABLE CANOPY

[76] Inventor: John W Caldwell, 1829 Warwick Rd., San Marino, Calif. 91108

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,596

[22] Filed: Jun. 12, 1997

[51] Int. Cl.[7] ..... E04H 15/26

[52] U.S. Cl. ..... 135/99; 135/88.11; 135/143; 135/151; 135/907; 160/121.1

[58] Field of Search ..... 135/16, 19, 31, 135/19.5, 20.3, 21, 33.2, 33.41, 98, 99, 96, 95, 97

[56] References Cited

U.S. PATENT DOCUMENTS

| | | | |
|---|---|---|---|
| 814,473 | 3/1906 | Patterson | 135/99 X |
| 1,633,820 | 8/1927 | Long et al. . | |
| 2,634,740 | 4/1953 | Duke | 135/98 X |
| 3,101,731 | 8/1963 | Stiglin | 135/98 X |
| 3,384,519 | 5/1968 | Froget | 160/121.1 X |
| 3,890,989 | 6/1975 | Kuxhouse et al. . | |
| 4,086,931 | 5/1978 | Hall | 135/98 |
| 4,250,908 | 2/1981 | Rivier et al. . | |
| 4,480,675 | 11/1984 | Berkemeier | 160/121.1 |
| 4,502,674 | 3/1985 | White et al. | 160/121.1 X |
| 4,610,262 | 9/1986 | Broyer et al. | 135/31 X |
| 5,247,956 | 9/1993 | Vincent | 135/31 X |
| 5,320,154 | 6/1994 | Colson et al. | 160/121.1 |
| 5,370,144 | 12/1994 | Yang | 135/31 X |

FOREIGN PATENT DOCUMENTS 0819212 10/1937 France .

*Primary Examiner*—Carl D. Friedman
*Assistant Examiner*—Winnie S. Yip
*Attorney, Agent, or Firm*—Donald D. Mon

[57] ABSTRACT

A storable shelter deployable to a dihedral configuration. It includes a central pole with an upright axis, a pair of flexible rectangular panels and a control for them which includes at least one rotatably biased reel, an edge former for each panel, a strut for each panel which strut is rigid when the shelter is deployed, the edge formers extending as a straight body from both sides of the struts, a collar freely slidable on the pole and a mount on the collar rotably mounting the struts. The collar is raised to lower the struts and deploy the panels and lowered to enable the struts to move against the pole where upon the panels are wound on the reel or reels by the rotational bias of the reel or reels.

19 Claims, 6 Drawing Sheets

40
46
6
6
42
44
41
50
46

10
10
81
79
77
21
75
76
80

79
81
77
21
75
76
80

SELF-STANDING SHELTER WITH REEL-MOUNTED DEPLOYABLE AND RETRACTABLE CANOPY

FIELD OF THE INVENTION

A self-standing shelter with a reel-mounted canopy that can be retracted for storage and deployed to provide shelter.

BACKGROUND OF THE INVENTION

Conventional collapsible umbrellas include a canopy which is usually either circular or polygonal, and conical or pyramidal, when deployed. To deploy, shape and support their canopy they generally include a control with a collar that slides along a vertical post, and many sets of radial stays and struts grouped around the post.

The stays are hinged to the top of the post, and the struts are hinged to the collar. Stays and struts are hinged to each other in pairs, so when the collar is brought down, the struts follow it and pull the stays and themselves against the post.

The canopy fits over the top of the post, and often is fixed to it. It is attached to the stays. Sometimes the stays are stitched into the canopy or are fitted in a slot in the canopy. In other types, the canopy includes pockets into which the ends of the stays are inserted.

Such controls are complex and costly, and the canopy shapes are complex, both of which add material and labor cost. Often a broken control cannot readily be repaired, and the canopies, of course, are custom made to these rather complex shapes.

Because these conventional constructions are conical or pyramidal, they tend to trap air beneath them in the wind, and are too-readily blown over. Some larger sized canopies are provided with vents and covers to enable at least some of the air trapped by the canopy to escape, and hopefully reduce the likelihood of being blown away by the wind. The shape of canopy which is enabled by this invention does not trap air and is much less likely to blow away.

Conventional folding umbrellas when collapsed necessarily form a bulky, poorly disciplined bundle in which the entire soiled upper surface of the canopy must be directly handled by the person who puts it away. Also, the person who takes down the umbrella is directly in the path of the descending edge of the canopy. He must be nimble.

In addition, most conventional umbrellas are formed at their edges as a circle or as a polygon with a number of edges. These shapes when deployed are generally not able to be placed next to one another to provide a continuous shelter. There will usually be intervening gaps.

It is an object of this invention to provide a shelter in which the canopy is mounted on a reel that is spring loaded toward retraction so that when it is retracted, the canopy is stored on a reel with only a small outer surface exposed, and this above the head of the user.

It is another object of this invention to provide a control with only one strut, and no radial stay, for each side of a dihedral canopy with a single central dihedral edge.

It is another object of this invention to provide a dihedrally shaped canopy which can be abutted neatly to its neighbor so as to provide either a long clear span of a plurality of canopies, or a series of transversely "notched" structures. Both have an optimum head clearance and a remarkably uncluttered appearance due to the absence of the complex controls used in conventional umbrellas. The user of the shelter of this invention sees only one transverse strut on each side of the post for each canopy, and sees these only when looking along the "trough" of the deployed canopy.

It is another object of this invention to provide a canopy that is simply formed by a rectangular piece of fabric, rather than assembled from many pieces to form the complex shapes required for conventional umbrellas.

It is yet another object of this invention to provide means for the reel or reels, edge formers, and canopy to be tilted as a body against the center pole when retracted.

BRIEF DESCRIPTION OF THE INVENTION

A shelter according to this invention includes a canopy that is a rectangular sheet of flexible material. Its shape and its storage and deployment are caused by a control that is attached to a post. The post is usually upright.

The control includes a reel onto which the canopy is wound for storage, and from which it is unreeled for deployment. According to a preferred but optional feature of the invention, the reel is spring loaded toward the retracted, stored condition, so as to exert a continuing stretching force on the deployed canopy. The reel is supported atop the post. Its axis of rotation is generally horizontal when the post is vertical.

The control includes a collar which is slidably fitted on the post. Two struts are hinged to the collar, diametrically opposite from one another. Each strut extends to a rigid edge former to which the edge of the canopy farther from the reel is fitted or attached. The edge former extends normally to the strut, horizontally when the post is upright.

Moving the collar upwardly while also pivoting the struts away from the post will draw the canopy from the reel under tension. When the strut is fixed in position, the dihedral angle and the exposed area of the canopy are determined. The collar can then be pinned or otherwise locked or fastened in place.

If desired, both panels of the canopy can be wound on only one reel. If it is desired to have different angles relative to the ground for one panel relative to the other, a separate reel will be provided for each panel and the length or the angle (or both) relative to the horizontal of at least one strut at deployment will be made adjustable.

The above and other features of this invention will be fully understood from the following detailed description and the accompanying drawings, in which:

DETAILED DESCRIPTION OF THE INVENTION

Figure 1:
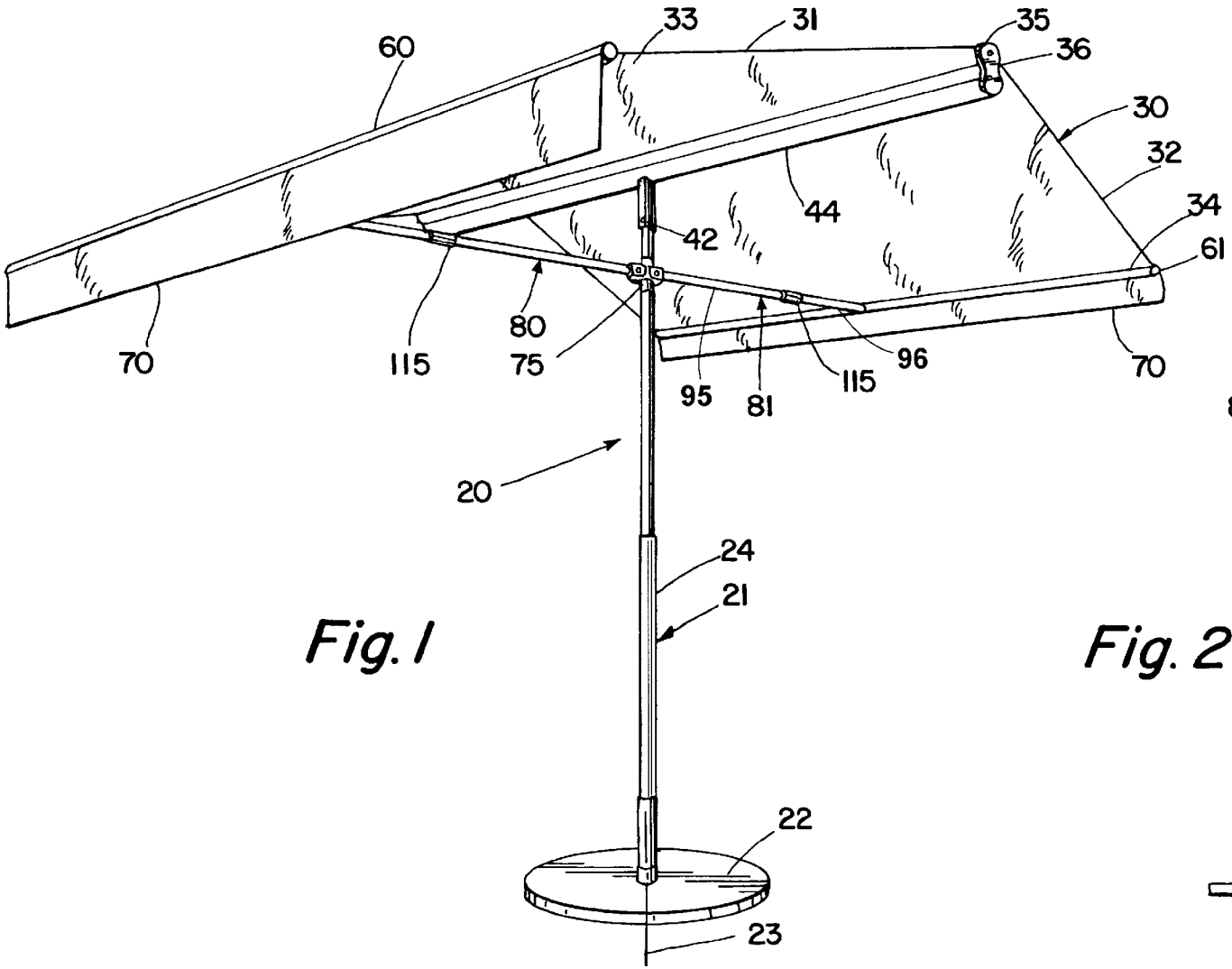
FIG. 1 is a side elevation of the presently-preferred embodiment of the invention in its deployed configuration.

A shelter 20, used as an umbrella, is shown in its erect, deployed, free-standing configuration in FIG. 1. A central pole 21, which is usually vertical when in use, is mounted to a supporting pedestal 22. The pole has a central axis 23, an outer wall 24, usually cylindrical, and an upper end 25.

It is the object of this invention to retract and store, or to deploy, a canopy 30. The canopy has two canopy panels 31, 32, with respective free edges 33,34. The panels are rectangular or square, and when deployed present a rectangular or square area. These areas are substantially planar, and meet at or near their inner edges 35, 36 to form a dihedral angle at the ridge. The canopy panels are flexible, and can be wound onto a reel or reels, as will later be shown in detail.

A control 40 for these panels includes a transversely extending reel mount 41. This mount includes a socket 42 (FIGS. 3, 6 and 7) adapted closely to receive upper end 25 of the pole. For rigidity the mount includes a T-shaped extrusion 43 with a downwardly-depending flange 44 and a horizontal plate 45, which are attached to the socket, such as by a weldment 45*a*.

At each end, an anchor plate 46 is mounted to extrusion 43. A reel 50 is mounted to a plate 46 at each end. If two reels are provided, both reels will be mounted to these anchor plates. This part of the control is common to both embodiments. The reel is a typical spring-wound reel biased to rotate in the direction which will wind the panel or panels onto the reel. The internal mechanism of such a reel is common, such as a conventional spiral spring and is not shown in detail. It is not necessarily a locking reel in the sense of a window shade, although it can be. Best results are attained when the reel maintains a prevailing stretching force on the panels to keep them taut.

Figure 6:
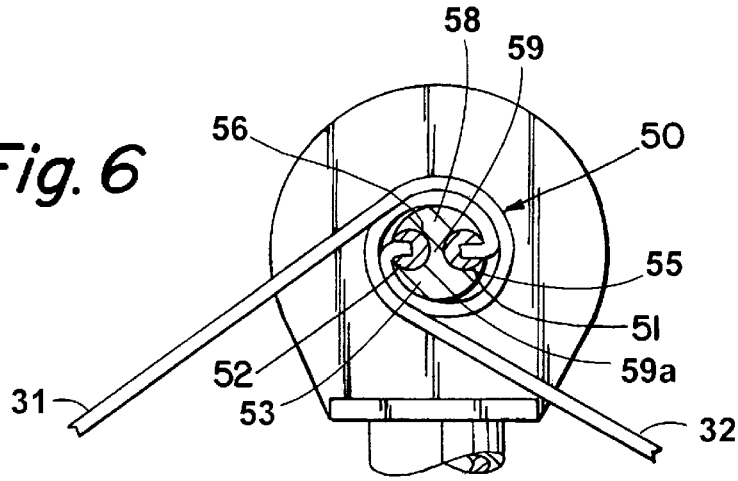
FIG. 6 is a cross-section of a preferred reel for the control on which both panels are wound.

As best shown in FIG. 6, the reel has a central axis of rotation 59 and a core 58. The core has an outer surface 53 on which the panels are wound. When both panels are to be wound on a single reel, as in FIGS. 1 and 6, the core will have two re-entrant recesses 51, 52 which will respectively receive enlarged inner ends 55 and 56 of panels 31 and 32. These enlarged ends are slipped endwise into the recesses. The thickness of the enlarged end is greater than the opening gap of the recess, so the panel is held to the reel.

When the panels are both wound on the same reel, they overlay each other, but will be fed out in opposite directions.

Figure 8:
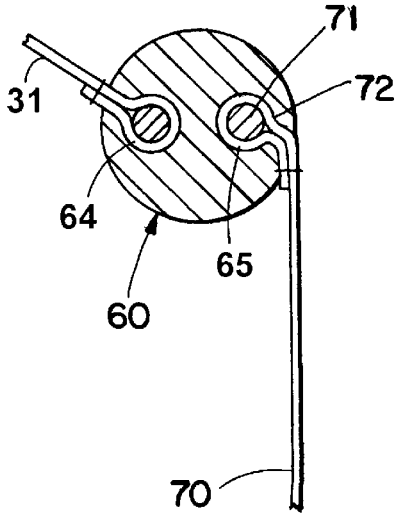
FIG. 8 shows an edge former for use in the control.
Figure 9:
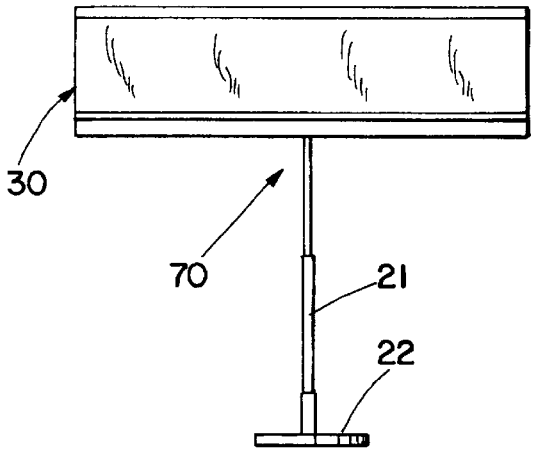
FIG. 9 is a side view of FIG. 1.

The control also includes edge formers 60, 61, which are attached to the free edges of the panels. They are identical. Edge former 60 is shown in detail in FIG. 8. It includes a re-entrant recess 64 and an optional similar recess 65, both of which extend for the length of the edge former. The enlarged end of the panel is inserted into the recess from its end. The combined thickness of the panel and rod is greater than the width of the opening into the recess. This disciplines the free edge of the panel.

If desired, a skirt or fringe 70 can be attached to the edge former at recess 65 in the same way as the panel. A rod 71 in a stitched loop 72 on the skirt serves this purpose both for the edge of the panel and for the skirt.

Figures 3, 4, 5:
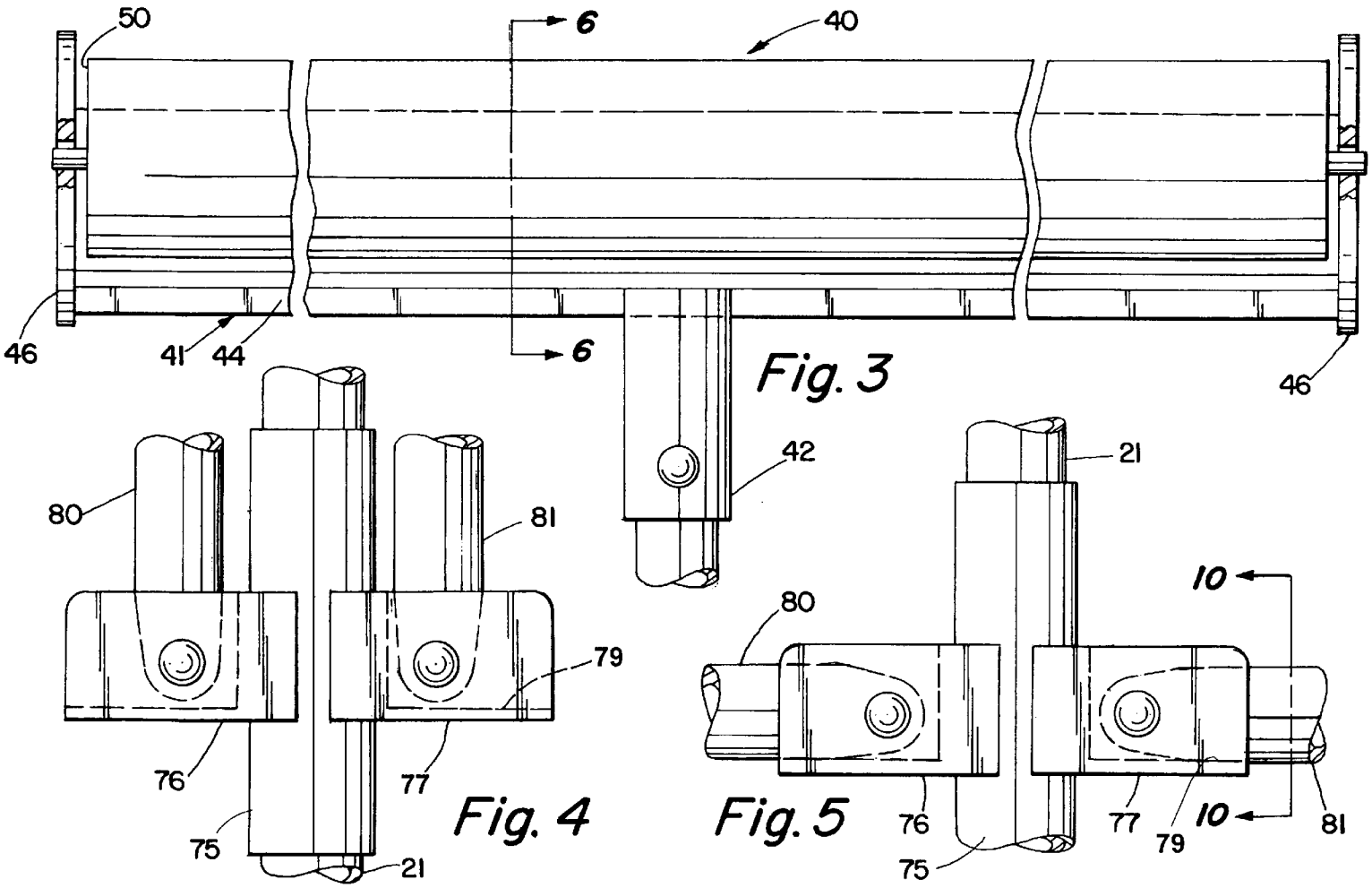
FIG. 3 is a fragmentary side view, partly in cutaway cross-section, showing a portion of the control.
FIG. 4 is a fragmentary side view of a collar used in the control in the stored configuration.
FIG. 5 is a fragmentary view as in FIG. 4, showing the collar in the deployed configuration.
Figure 10:
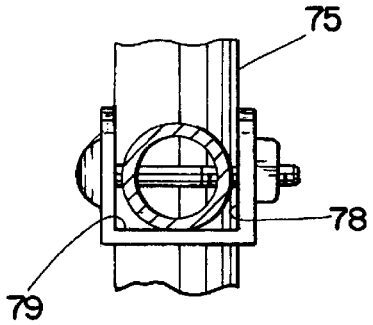
FIG. 10 is a cross-section taken at line 10—10 in FIG. 5.

The control further includes a collar 75 (FIGS. 4 and 5) slidably fitted on the post. It includes hinge mounts 76, 77 fixed to the collar at diametrically opposite sides. The mounts are identical, and include a radially directed U-shaped channel 78 (FIG. 10). Struts 80, 81 are hinged to mounts 76, 77 respectively so they can swing between a horizontal position (FIG. 5) to a nearly upright position (FIG. 4). When in the position of FIG. 5, the struts are supported against pivoting to a still lower position by the bottom 79 of the channel, and are supported against sideward movement by the walls of the channel.

Struts 80, 81 are respectively connected to edge formers 60 and 61.

Figure 7:
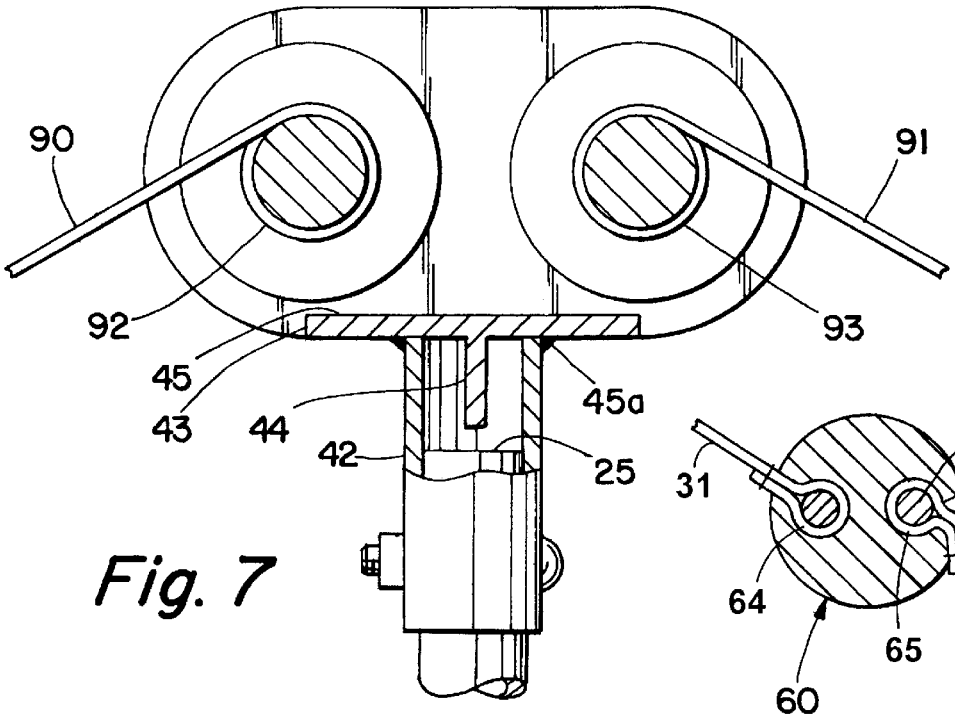
FIG. 7 is a cross-section of another embodiment of reel means, in which a separate reel for each panel is provided.
Figure 15:
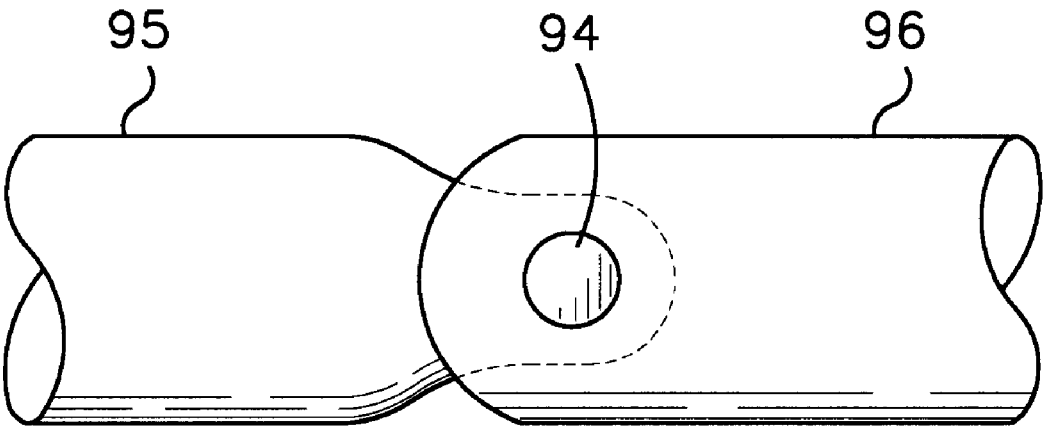
FIG. 15 is a fragmentary side view of an optional modification of a strut.

As will be understood below, when the two panels are mounted to a single reel, their deployed angles relative to the horizontal will be identical. Should it be desired to have the angles be different from one another, then panels 90, 91 must be mounted to separate reels 92, 93 as shown in FIG. 7. These will be separately spring-wound. In that event one or both struts may be made adjustable in angle so that, when the strut is adjusted, the angle of the panel relative to the vertical will be different when the strut's length is adjusted, such as by a slip fitting as in a two piece strut (FIG. 1), by changing the angle at which the strut is restrained from below, or by incorporating an adjusted hinge 94 between adjacent strut segments 95 and 96 (FIG. 15).

Figure 11:
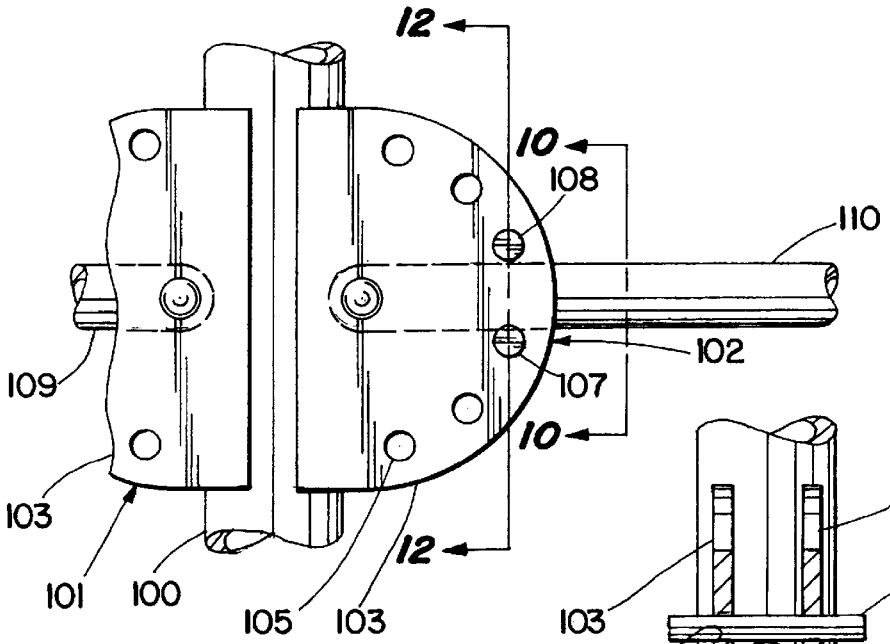
FIG. 11 is a fragmentary side view of another form of collar.

When two reels are used, it is possible to provide the same area of deployed canopy on both sides, but with one at a different angle relative to the vertical, or with both at a different angle detained by the strut angle, or with a different area. This requires a different construction of at least one of the hinge mounts, as shown in FIG. 11. Collar 100 has a pair of hinge mounts 101, 102. Instead of a hinge mount rigidly fixed to the collar, a pair of channels plates 103, 104 are fixed to the collar on each side. These plates have an arcuate series of aligned pin holes 105, 106 to receive cross pins 107, 108. Struts 109, 110 are pivoted to the plates at the center of the arc of holes and can be held at an adjusted position, which may be horizontal, or sloping up, or down by trapping it between pins. The reel will feed out the appropriate length of canopy fabric.

The term "reel means" in intended to describe both a single reel and a double reel device. The term "mount means" is intended to describe how the struts are pivotally mounted to the collar. A simple hinge is an example. It may also include the channel member which supports a hinge pin.

Alternately or additionally the adjustable hinge 94 may be included between two strut segments, which will provide a different range of possible deployments.

The operation of this shelter is straightforward. With both panels stored on the reel of FIG. 6, and the control in the configuration of FIG. 2; the struts have been pivoted upward, and the panels been drawn onto the reel by the spring in the reel. In this condition, the assembly can be removed from the pedestal and stored. If desired, the pole can also be removed, or if it is a two piece pole, one part of the pole may be removed. In addition, should it be desired to store the reel parallel to the struts, appropriate pivots can be provided to permit the reel mount and edge formers to rotate as one to approach parallelism with the pole.

Alternatively, the edge formers can be separated from the struts and drawn against the reel. The reel assembly can then be removed from the pole. The collar and struts can be stored alongside the pole, or the pole can be removed for most compact storage.

To deploy the panels, the collar is moved upwardly, and the struts are spread apart. When the struts bottom out in the channels or otherwise reach a defined position, the outer edges of the panels are fixed in place. The reel will have fed out the panel sheet in response to movement of the strut and the edge formers. Then the collar is pinned or otherwise fixed to the post. When the strut is to be fixed approximately horizontally and the mount of FIG. 10 is used, a pin is not usually necessary, but may be used if desired.

Figure 2:
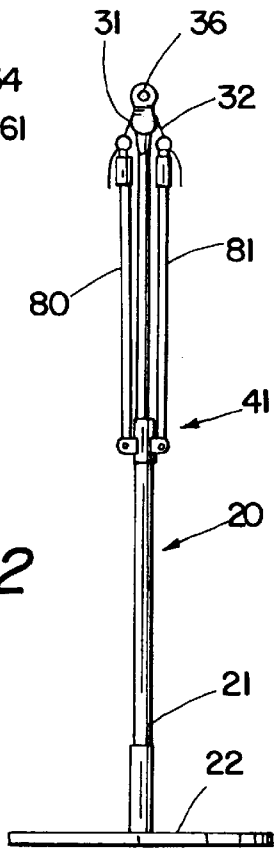
FIG. 2 is a side elevation, as in FIG. 1, showing the shelter in its retracted stored configuration.

To retract and store the panels, the collar is unpinned and slid down the post, while the struts are brought to the position shown in FIG. 2. The shelter is now compact, and the user is not exposed to loose soiled folds of a canopy. Only the outermost convolution of the panel or panels is exposed, and it can be covered if desired.

The operation and storage of a two reel model is the same, except that the panels are wound on different reels, and there will be a gap between them at the ridge. When different sizes or angles of the panels are desired, the mounts will be adjusted as desired.

Figure 14:
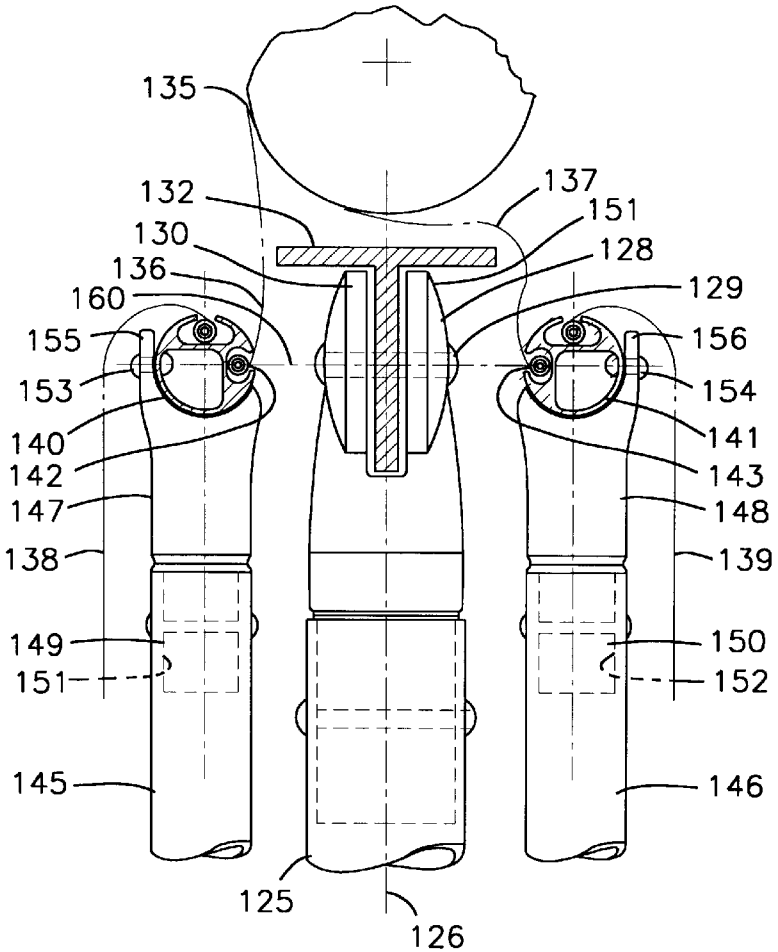
FIG. 14 is a fragmentary cross-section taken at line 14—14 in FIG. 13.
Figure 13:
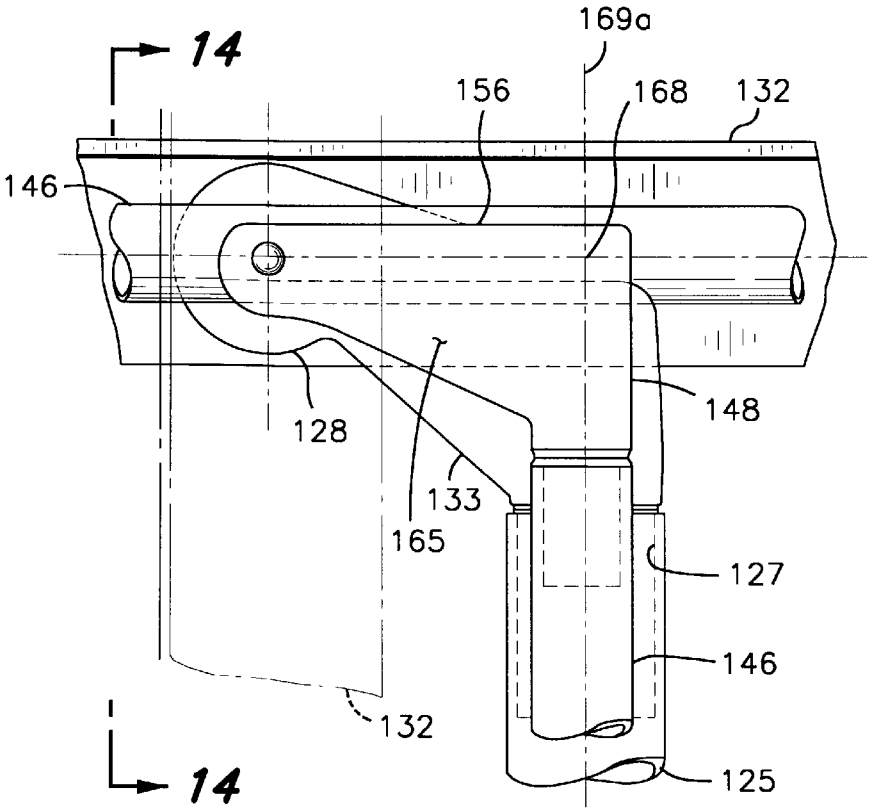
FIG. 13 is a fragmentary side view of a modification which permits the reel to be tilted for storage.

Especially when the shelter is to be deployed and retracted frequently, as would be the situation in patio cafes, for example, a more convenient mounting for the reel or reels and edge formers will be justified. FIGS. 13 and 14 show means to mount the reel or reels and the edge formers so they can be tilted to stand alongside the central pole without the necessity of separating any of them from their supporting structures.

FIG. 13 shows a central pole 125 with an axis 126 that is generally upright when in use. It has a tubular upper socket 127 that receives a clevis 128. A hinge pin 129 extends through and between clevis arms 130, 131. A reel mount 132, which will be recognized as the same as reel mount 41 in FIG. 7, has a hole through which hinge pin 129 passes. This tiltably holds the reel mount so it can rotate in the plane of FIG. 13. Reel 135 is rotatably mounted to the reel mount by the same means as is provided in FIG. 6. If two reels are used, they will be mounted as in FIG. 7.

To provide clearance for the reel (or reels) when tilted alongside the pole a clevis 128 includes an offset portion 133 which positions hinge pin 129 laterally from the pole.

Canopy panels 136, 137 are shown in FIG. 14, both being wound on the same reel. Edge formers 140, 141 are joined to the free edges 142, 143 of panels 136 and 137. Skirts or fringes 138, 139 are similarly attached to edge formers 140, 141.

Figure 12:
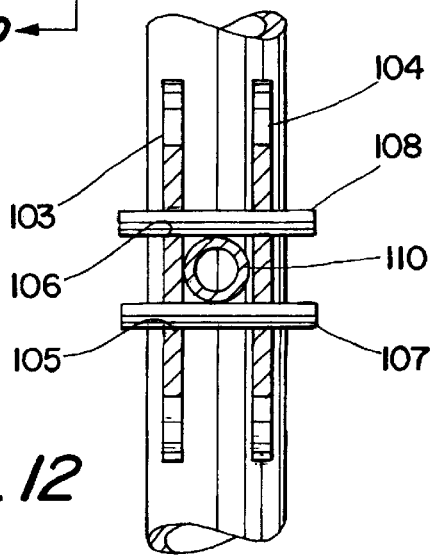
FIG. 12 is a cross section taken at line 12—12 in FIG. 11.

The outermost parts of struts 145 and 146 are shown in FIGS. 13 and 14. These struts will be mounted to a collar (not shown) as in FIGS. 4 and 5, or in FIGS. 10–12. Fittings 147, 148 are attached to the ends of struts 145 and 146, plug ends 149, 150 being pressed into and retained in tubular sockets 151, 152 in the ends of the struts.

Pivot pins 153, 154 are fitted in arms 155, 156 at the upper ends of the fittings. These tiltably mount the edge formers to the ends of the strut. They can be rotated in the plane of FIG. 13.

It will noticed that the axis 160 of hinge pin 129 for the reel mount, and of pivot pins 153 and 154 for the edge formers is common to all of them. This will enable the reel (or reels), the edge formers, and all panel fabric that is not on the reel, to rotate as one body around axis 160 so the reel or reels and the edge formers can be tilted as a unit toward parallelism with the central pole (or its axis).

It will be seen in FIG. 13 that fittings 147 and 148 include an offset portion 165. This enables axis 160 to be displaced laterally from the axis 126 of the center pole so that the reel can be laid alongside the pole without interference. The edge formers also tilt around axis 160, but of greater importance is the fact that the mid point 168 (FIG. 13) of the edge formers is aligned with axis 169 of its strut when in the deployed condition. Thus, the center point is aligned with the axis of the strut when the strut is deployed. Similarly, the mid-point 169*a* of the reel mount is aligned with the axis 126 of the pole in the deployed condition.

If desired, a trough-like channel 170 can be provided in the fitting, the better to support the edge formers while deployed use.

Pins (not shown) may be provided to hold the reel mount in the deployed position normal to the axis of the pole. Similar means can be provided for the struts, although they usually will be unnecessary.

This invention is not to be limited by the embodiments shown in the drawings and described in the description, which are given by way of example and not of limitation, but only in accordance with the scope of the appended claims.

I claim:

1. A shelter adapted to be stored, and to be deployed to dihedral configuration, said shelter comprising: a central pole having an upright axis; a pair of generally rectangular flexible canopy panels, each having an inner edge and an outer free edge; and a control for said canopy, said control comprising:

reel means mounted to the top of said pole, extending transversely thereto, said inner edges of both of said panels being fixed to said reel means and being rotatably biased to retract said panels and wind them onto said reel means, said bias exerting a prevailing force on said panels in the direction of retraction;

a rigid edge former attached to said outer edge of each of said panels:

a strut which is rigid when the shelter is deployed connected to each of said edge formers, each of said edge formers extending as a straight body from both sides of its respective strut;

a collar encircling said pole and freely slidable along it;

a mount on said collar hingedly mounting said struts to said collar for free rotation relative to said struts relative to said collar;

whereby with the struts adjacent to said pole, said reel means will have wound the panels on said reel means and thereby retracted the panels and brought the edge formers into near adjacency to the pole, and the collar will have slid down the pole, and when the panels are to be deployed the collar will be raised and the struts folded down to draw the panels under tension to a position which is established only by the location of the collar along the pole and by the distance between the mount and the respective edge former as established by the rigid strut.

2. A shelter according to claim 1 in which a separate skirt is attached to at least one of said edge formers.

3. A shelter according to claim 1 in which said reel means comprises a single reel on which both of said panels are wound for storage, and from which they are unwound for deployment.

4. A shelter according to claim 1 in which said reel means comprises a pair of reels, a respective panel being wound on each of said reels for storage, and from which it is unwound for deployment.

5. A shelter according to claim 4 in which at least one of said struts includes two segments and an adjustable hinge between said segments to provide for adjustability of the position of its respective edge former and thereby the area and angle of deployment of its respective panel.

6. A shelter according to claim 4 in which said mount includes, for at least one of said struts, adjustment means to hold said strut in an adjusted position whereby to establish the angle of the respective strut when deployed so as to vary the area and angle of deployment of its respective panel.

7. A shelter according to claim 6 in which said mount includes a channel member to support said strut against tilting and sideward movement.

8. A shelter according to claim 1 in which said mount includes, for at least one of said struts, a pair of spaced-apart plates fixed to said collar, its respective strut being pivotally mounted to said plates, and in which means is provided with said plates to hold said strut in a selected angular position.

9. A shelter according to claim 8 in which said plates include at least one pair of aligned holes said last-named means comprising a pin adapted to fit in said aligned said holes, and to extend between the plates to restrain the strut.

10. A shelter according to claim 1 in which said reel means includes a reel having a reel axis of rotation and a reel mount, adapted to fit atop said pole, said reel mount including an offset portion with a pivot, which offset portion spaces and holds said reel so that its reel axis is laterally spaced from said pole, and in which both of said struts include a respective edge former fitted to its free end, said offset portion including a pivot joined to respective said edge formers, said pivots for said edge formers and for said reel being in substantial axial alignment with one another when in the stored configuration, whereby said reel means and said edge formers can be rotated as a unit to extend adjacent to said pole.

11. A shelter according to claim 10 in which the mid point of said reel means and said edge formers are respectively aligned with the axis of the pole and the struts when said shelter is in its deployed configuration.

12. A shelter according to claim 1 in which said reel means is detachable from said pole, and said edge formers are detachable from said struts to allow for more convenient storage of the apparatus after retraction.

13. A shelter according to claim 4 in which at least one of said struts includes two aligned segments whose combined length can be adjusted to provide for adjustability of the position of its respective edge former, and thereby the area and angle of deployment of its respective panel.

14. A shelter according to claim 13 in which adjustment means is provided to hold said two strut segments in a selected relative position.

15. A shelter according to claim 3 in which at least one of said struts includes two segments and an adjustable hinge between said segments to provide for adjustability of the position of its respective edge former and thereby the area and angle of deployment of its respective panel.

16. A shelter according to claim 3 in which said mount includes, for at least one of said struts, adjustment means to hold said strut in an adjusted position whereby to establish the angle of the respective strut when deployed so as to vary the area and angle of deployment of its respective panel.

17. A shelter according to claim 16 in which said mount includes a channel member to support said strut against tilting and sideward movement.

18. A shelter according to claim 3 in which at least one of said struts includes two aligned segments whose combined length can be adjusted to provide for adjustability of the position of its respective edge former, and thereby the area and angle of deployment of its respective panel.

19. A shelter according to claim 18 in which adjustment means is provided to hold said two strut segments in a selected relative position.

* * * * *